US007258628B2

(12) United States Patent
Huang et al.

(10) Patent No.: US 7,258,628 B2
(45) Date of Patent: Aug. 21, 2007

(54) INTENSIFIED STRUCTURE FOR CONNECTING A GOLF CLUB HEAD BODY WITH A STRIKING PLATE

(75) Inventors: Chun-Yung Huang, Kaohsiung Hsien (TW); Chan-Tung Chen, Kaohsiung (TW)

(73) Assignee: Nelson Precision Casting Co., Ltd., Kaohsiung (TW)

( * ) Notice: Subject to any disclaimer, the term of this patent is extended or adjusted under 35 U.S.C. 154(b) by 280 days.

(21) Appl. No.: 11/031,064

(22) Filed: Jan. 10, 2005

(65) Prior Publication Data

US 2006/0154743 A1 Jul. 13, 2006

(51) Int. Cl.
*A63B 53/04* (2006.01)

(52) U.S. Cl. ..... 473/342; 473/345; 473/350

(58) Field of Classification Search ..... 473/324–350
See application file for complete search history.

(56) References Cited

U.S. PATENT DOCUMENTS 5,871,408 A 2/1999 Chen
6,506,129 B2 * 1/2003 Chen ..... 473/329
6,743,120 B1 6/2004 Chen
6,746,342 B1 6/2004 Hsieh
6,749,524 B1 * 6/2004 Chen ..... 473/342
6,918,841 B2 * 7/2005 Chen ..... 473/342
6,971,961 B2 * 12/2005 Chen ..... 473/342
2003/0217216 A1 * 11/2003 Rowlands ..... 710/305
2004/0033844 A1 2/2004 Chen
2005/0181890 A1 * 8/2005 Huang ..... 473/342
2006/0217216 A1 * 9/2006 Iizuka ..... 473/349

* cited by examiner

*Primary Examiner*—Sebastiano Passaniti
(74) *Attorney, Agent, or Firm*—Birch, Stewart, Kolasch & Birch, LLP

(57) ABSTRACT

A golf club head includes a golf club head body having a connecting groove and a filling space, and a striking plate having an annular upright bent wall and a connecting end. In assembling, the connecting end of the annular upright bent wall of the striking plate is initially inserted into the connecting groove of the golf club head body so that an intensified structure is provided. The filling space of the golf club head body is further filled with a braze material. In brazing, the braze material contained in the filling space of the golf club head body is melted and thus filled within a clearance between the connecting groove of the golf club head body and the connecting end of the striking plate to form a welded layer.

28 Claims, 7 Drawing Sheets

INTENSIFIED STRUCTURE FOR CONNECTING A GOLF CLUB HEAD BODY WITH A STRIKING PLATE

BACKGROUND OF THE INVENTION

1. Field of the Invention

The present invention relates to an intensified structure for connecting a golf club head body with a striking plate. More particularly, the present invention relates to the golf club head body having a connecting groove, a filling space and engaging protrusions for connecting a striking plate by means of press fitting, deformation engagement and brazing.

2. Description of the Related Art

U.S. Pat. No. 5,871,408, issued to CHEN on Feb. 16, 1999, discloses a manufacture method for connecting a golf club head body with a striking plate. The golf club head body and the striking plate are made of metal. The golf club head body includes an assembling opening and a shoulder formed therein for connecting the striking plate thereto. In assembling, the shoulder of the golf club head body is adapted to support a braze material. The striking plate is a flat faceplate engaged with the shoulder of the golf club head body by pressing. Therefore, an annular protrusion of the shoulder is slightly deformed so that the braze material is filled up within a narrowed space defined among the striking plate, the shoulder and the annular protrusion. The braze material is made of powdered metal which has a melting temperature lower than those of golf club head body and the striking plate. In brazing, the combined golf club head body and striking plate is heated in a vacuum furnace or high temperature inert gas furnace which has a heating temperature higher than a melting temperature of the braze material, but lower than a melting temperature either of the golf club head body or the striking plate.

The braze material is melted and thus filled within any slight clearance formed between the golf club head body and the striking plate by capillary action after melting. The striking plate is securely connected to the golf club head body after cooling and hardening. Advantageously, a welded portion formed between the golf club head body and the striking plate is minimized in the welding process such that the golf club head product obtains a desired appearance due to slight welding traces.

However, the construction of the golf club head body has several drawbacks in the welding process. Firstly, the shoulder of the golf club head body can only provide with a limited volume within the golf club head body and the striking plate for receiving the braze material. Secondly, when the majority of the braze material is used to fill within a clearance between an inner peripheral wall of the assembling opening and an outer peripheral wall of the striking plate, spread in the welded portion between the golf club head body and the striking plate are caves and voids due to outflow of the braze material. The caves and voids generated in the welding process may weaken the entire structure of the golf club head. Inevitably, elastic deformations of the striking plate may generate an unwanted stress and thus cause cracks on the caves and voids spread in the welded portion between the golf club head body and the striking plate while striking golf. Because of this, the striking plate may disconnect or separate from the golf club head body after long-term use.

To solve this problem, a reinforcing connection between the golf club head body and the striking plate is required. To this end, a lip of the assembling opening of the golf club head provides with an engaging portion adapted to engage with the striking plate so as to avoid the striking plate separating from the golf club head body. Consequently, it may prolong the manufacture time and increase manufacture cost. Hence, there is a need for simplifying the connection structure of the golf club head body with the striking plate.

The present invention intends to provide an intensified structure for connecting a golf club head body with a striking plate. The golf club head body provides with a connecting groove to form a filling space for receiving a braze material. Furthermore, the connecting groove provides with a plurality of engaging protrusions on at least one peripheral wall to engage with an upright bent wall of the striking plate so as to intensify the connection structure, enhance connection reliability and extend useful life of the golf club head.

SUMMARY OF THE INVENTION

The primary objective of this invention is to provide an intensified structure for connecting a golf club head body with a striking plate. The golf club head body provides with a connecting groove and a filling space formed therein so as to receive a braze material. Accordingly, the connecting groove of the golf club head body connects with an upright wall of the striking plate in brazing process that intensifies the connection structure and enhances connection reliability of the golf club head.

The secondary objective of this invention is to provide the intensified structure for connecting the golf club head body with the striking plate. The golf club head body provides with a connecting groove and a plurality of engaging protrusions formed on at least one peripheral wall so as to engage with an upright bent wall of the striking plate. Accordingly, the engaging protrusions of the connecting groove of the golf club head abuts against the upright wall of the striking plate in assembling process that intensifies the connection structure and enhances connection reliability of the golf club head.

The golf club head in accordance with the present invention includes a golf club head body and a striking plate connected thereto. The golf club head body provides with an opening and an annular lip thereof at a front side. The annular lip includes a connecting groove and a filling space adjacent thereto. The striking plate provides with an annular upright bent wall and a connecting end connected thereto. In assembling, the connecting end of the annular upright bent wall of the striking plate is initially inserted into the connecting groove of the golf club head body so that an intensified structure is provided. The filling space of the golf club head body is further filled with a braze material. In brazing, the braze material contained in the filling space of the golf club head body is melted and thus filled within a clearance between the connecting groove of the golf club head body and the connecting end of the striking plate to form a welded layer.

Further scope of the applicability of the present invention will become apparent from the detailed description given hereinafter. However, it should be understood that the detailed description and specific examples, while indicating preferred embodiments of the invention, are given by way of illustration only, since various will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
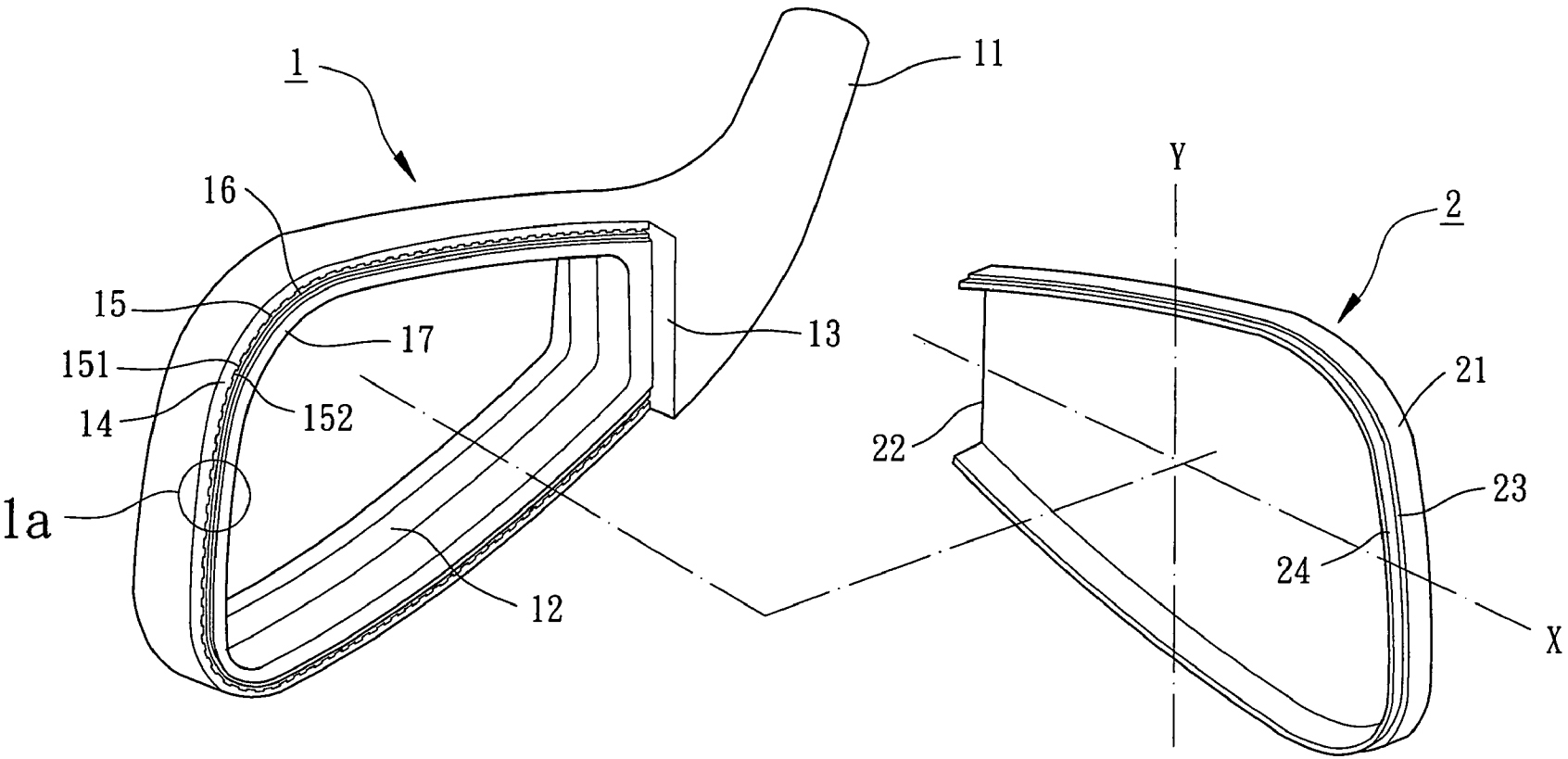
FIG. 1 is an exploded perspective view of a golf club head having an intensified structure for connecting a club head body with a striking plate in accordance with a first embodiment of the present invention.
Figure 2:
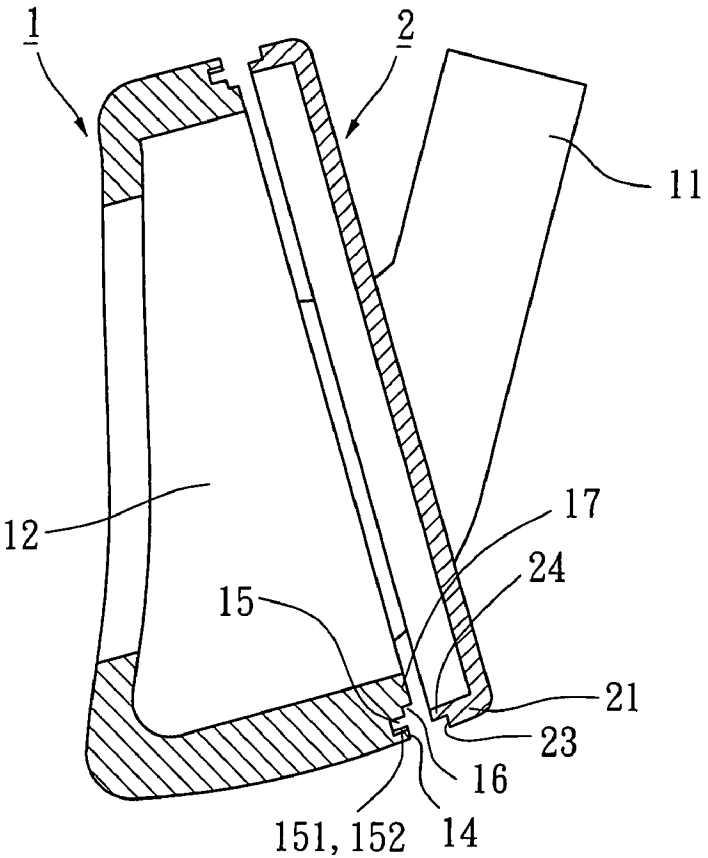
FIG. 2 is an exploded cross-sectional of the golf club head having the intensified structure for connecting the club head body with the striking plate in accordance with the first embodiment of the present invention.
Figure 1A:
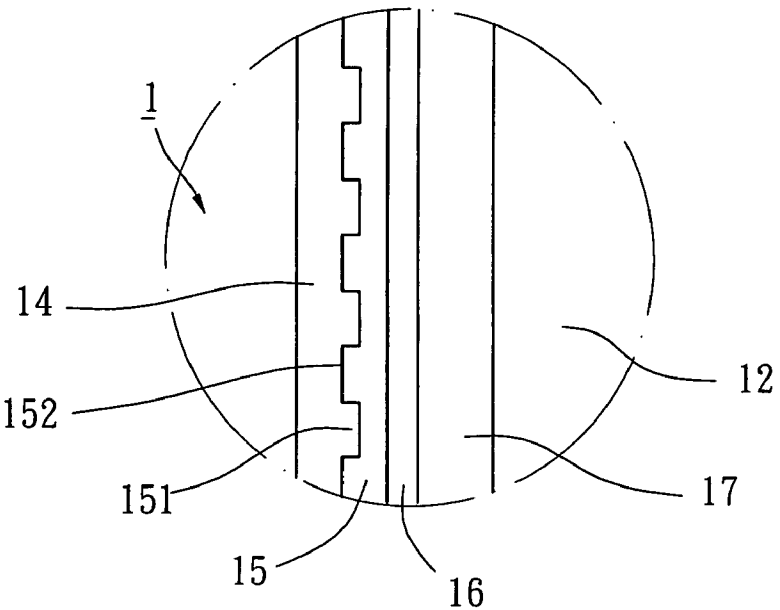
FIG. 1*a* is an enlarged view, in FIG. 1, of the intensified structure of the club head body in accordance with the first embodiment of the present invention.

Referring initially to FIGS. 1, 1*a* and 2, a golf club head generally includes a golf club head body member designated numeral 1 and a striking plate member designated numeral 2. The golf club head can be selected from a group consisting of an iron-type club head, a wood-type club head and a putter-type club head. In the following embodiment, an intensified structure in accordance with the present invention shall be only applied to the iron-type and wood-type club heads. It will be understood that the intensified structure applied to the putter-type club head in accordance with the present invention is omitted.

Referring again to FIGS. 1, 1*a* and 2, the construction of the golf club head body 1 shall be described in detail. The golf club head body 1 is a monolithic shell including a hosel 11, an opening 12, a support wall 13, an engaging shoulder 14, a connecting groove 15, a filling space 16 and an annular lip 17. The hosel 11 is integrally connected or welded to the golf club head body 10 proximate to the support wall 13 and used to securely receive an end of a shaft (not shown). The golf club head body 1 has an interior in communication with the opening 12. The opening 12 is located at a front side of the golf club head body 1 and adapted to provide a space in which to permit elastic deformation of the striking plate 2 while striking golf. The engaging shoulder 14 extends along the annular lip 17 and terminates at the support wall 13. Located between the engaging shoulder 14 and the annular lip 17 are the connecting groove 15 and the filling space 16. The connecting groove 15 has an inner peripheral wall proximate to the filling space 16, and an outer peripheral wall beyond the filling space 16. Preferably, the outer peripheral wall of the connecting groove 15 is formed with a series of equi-spaced engaging protrusions 151 proximate to the engaging shoulder 14. Defined between any two adjacent engaging protrusions 151 is an auxiliary channel 152 which permits containing a melting braze material in brazing. The engaging protrusions 151 and auxiliary channels 152 are arranged in a staggered manner along the inner peripheral wall of the connecting groove 15. Preferably, each of the engaging protrusions 151 has a cubical block which can be mechanically deformed in a pressing operation.

Figure 3:
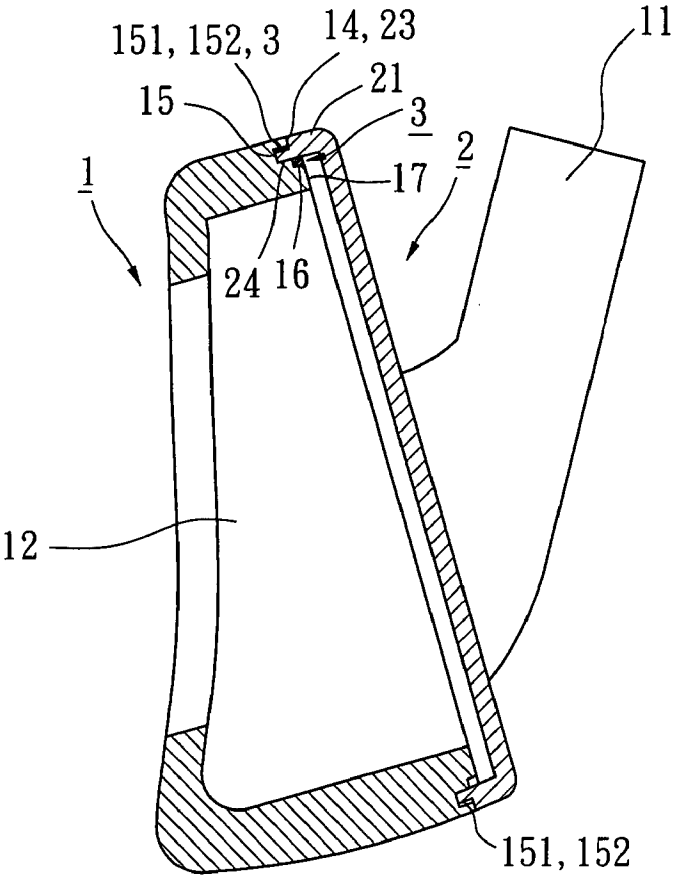
FIG. 3 is a cross-sectional view of the golf club head having the intensified structure connected the club head body with the striking plate in accordance with the first embodiment of the present invention.
Figure 5:
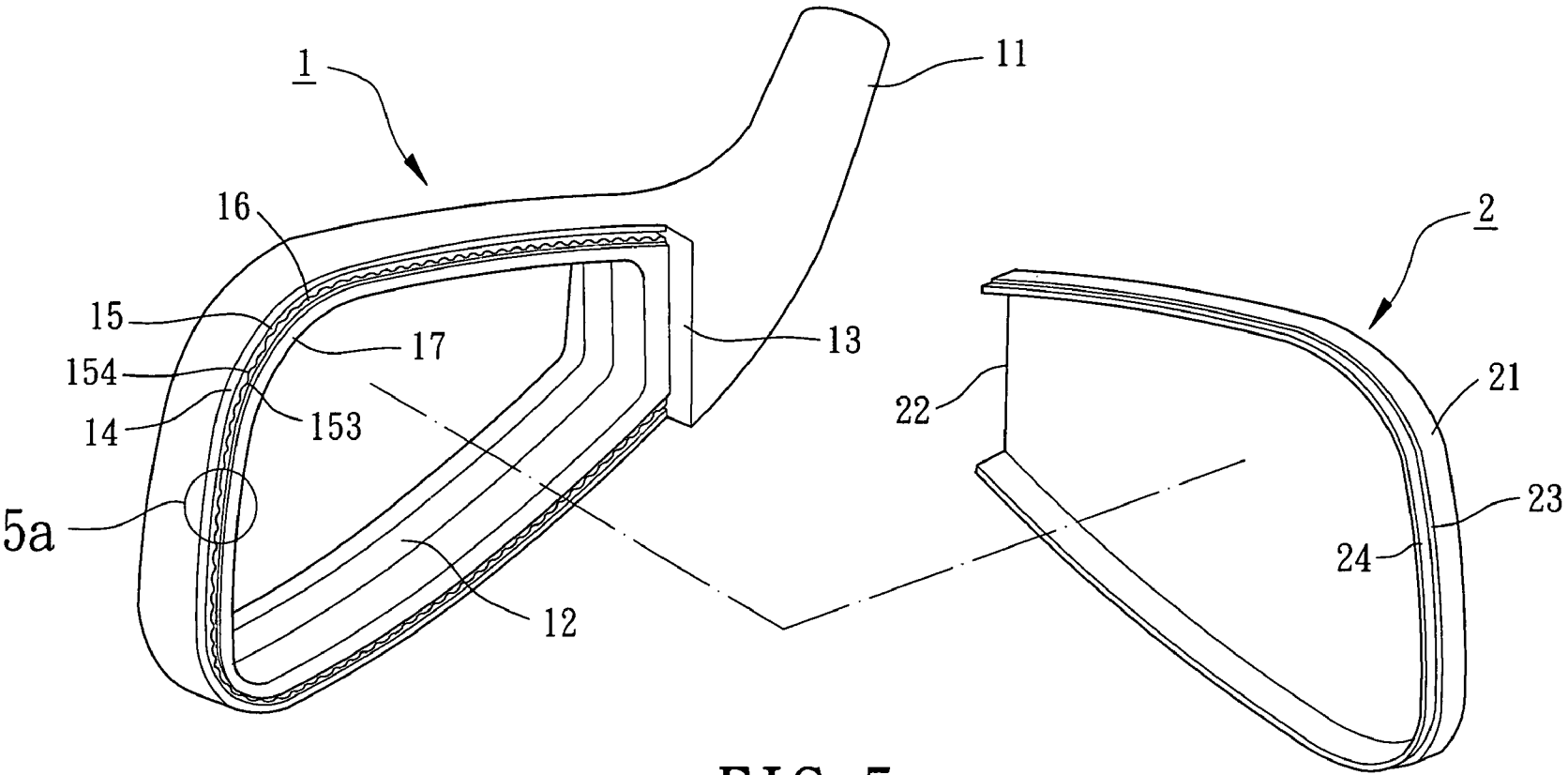
FIG. 5 is an exploded perspective view of the golf club head having the intensified structure for connecting the club head body with the striking plate in accordance with a third embodiment of the present invention.
Figure 6:
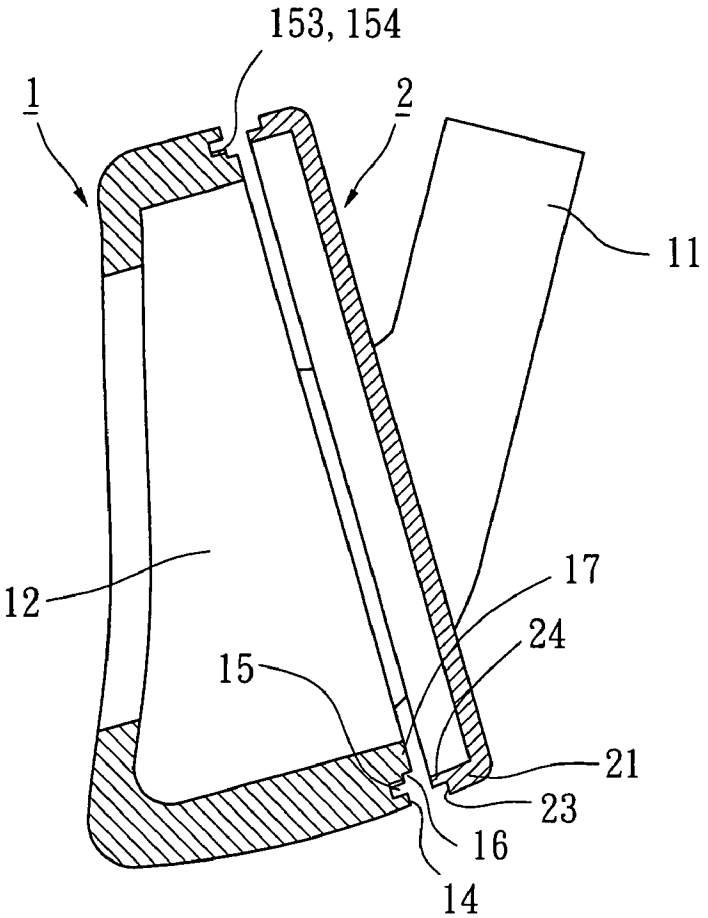
FIG. 6 is an exploded cross-sectional of the golf club head having the intensified structure for connecting the club head body with the striking plate in accordance with the third embodiment of the present invention.
Figure 5A:
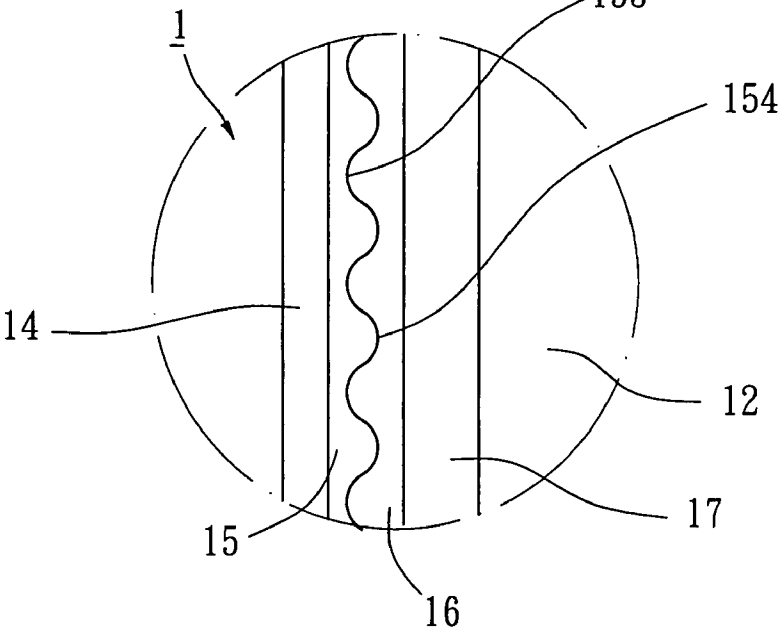
FIG. 5*a* is an enlarged view, in FIG. 5, of the intensified structure of the club head body in accordance with the third embodiment of the present invention.
Figure 7:
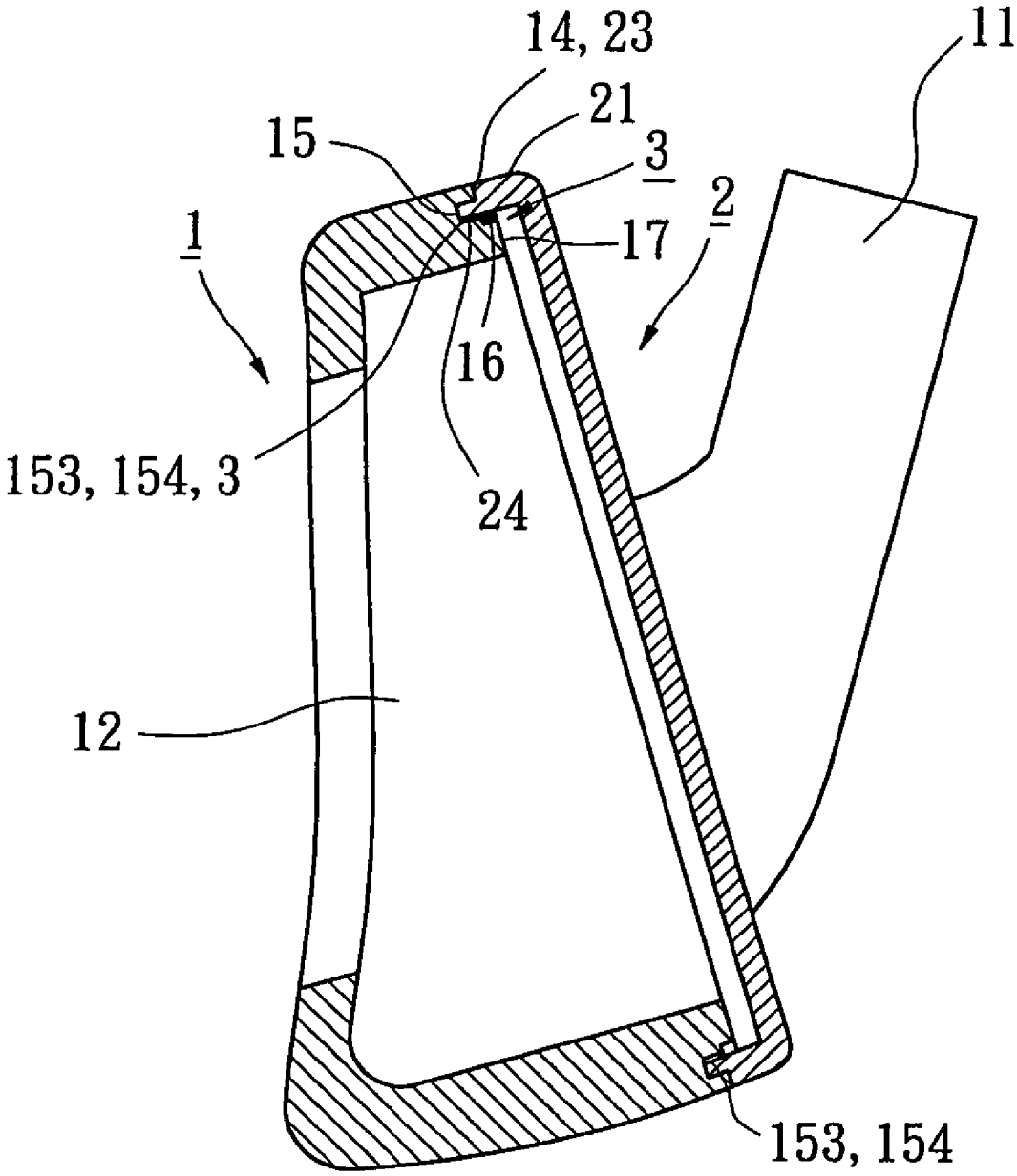
FIG. 7 is a cross-sectional view of the golf club head having the intensified structure connected the club head body with the striking plate in accordance with the third embodiment of the present invention.

Turning now to FIG. 3, some melting braze material 3 contained in the filling space 16 may be filled within the auxiliary channels 152 by capillary attraction. Defined between a side wall and a bottom wall of the filling space 16 is a cornered portion in which to receive the braze material 3. Preferably, the filling space 16 has a depth at the cornered portion not greater than that of the connecting groove 15 that permits the melting braze material flowing into the connecting groove 15 in brazing operation by gravity and capillary attraction. The side wall of the filling space 16 formed on the annular lip 17 can obstruct the melting braze material 3 so that outflow of the melting braze material 3 from the filling space 16 can be prevented.

Referring back to FIGS. 1, 1*a* and 2, the construction of the striking plate 2 shall be described in detail. The striking plate 2 includes an annular upright bent wall 21, a notch 22, an engaging shoulder 23 and a connecting end 24. A periphery of the striking plate 2 is bent to form the annular upright bent wall 21 which is extended in a backward direction towards the front side of the golf club head body 1. Located between two ends of the annular upright bent wall 21 is the notch 22 which is proximate to the hosel 11 of the golf club head body 1 after assembled, as best shown in FIG. 1. The striking plate 2 has a U-shaped sectional configuration along Y-axis or an L-shaped sectional configuration along X-axis. Both of the U-shaped configuration and the L-shaped configuration can perform excellently high COR (Coefficient of Restitution) characteristic. The engaging shoulder 23 and the connecting end 24 commonly connect to a top end of the annular upright bent wall 21 of the striking plate 2. Preferably, the engaging shoulder 23 is proximate to an outer surface of the striking plate 2 while the connecting end 24 being proximate to an inner surface of the striking plate 2.

Referring again to FIG. 3, the assembling operation of the golf club head body 1 and the striking plate 2 shall be described in detail. In assembling, the connecting end 24 of the annular upright bent wall 21 of the striking plate 2 must be aligned with the connecting groove 15 of the golf club head body 1. Subsequently, the connecting end 24 of the annular upright bent wall 21 of the striking plate 2 is initially inserted into the connecting groove 15 of the golf club head body 1 in a press-fitting manner so that the golf club head body 1 and the striking plate 2 are assembled. When this occurs, the support wall 13 of the golf club head body 1 and the notch 22 of the striking plate 2 are in perfect alignment with each other. Also, the engaging shoulder 14 of the golf club head body 1 and the engaging shoulder 23 of the striking plate 2 are in perfect engagement with each other. In press-fitting operation, a press force is exerted so that the engaging protrusions 151 formed in the connecting groove 15 are plastic-deformed in engaging with the connecting end 24 of the annular upright bent wall 21 of the striking plate 2. Because of this, the engaging protrusions 151 can securely fix the connecting end 24 of the striking plate 2 in the connecting groove 15 of the golf club head body 1. In the illustrated first embodiment, the engagement of the connecting end 24 of the striking plate 2 with the connecting groove 15 of the golf club head body 1 serves to maintain an assembled relationship without a need for an additional fastening tool in assisting to hold the two parts. In the event, the assembling operation for the golf club head is simplified. Once secured, the filling space 16 of the golf club head body 1 can be operated through a rear opening thereof. The braze material 3 is filled in-between the annular lip 17 of the golf club head body 1 and the inner wall of the annular upright bent wall 21 of the striking plate 2 as well as the filling space 16 in preparing brazing operation.

Still referring to FIG. 3, in brazing, the braze material 3 contained in the filling space 16 of the golf club head body 1 is heated and thus melted. Due to gravity and capillary attraction, on the one hand the melting braze material 3 is automatically filled within a clearance between the connecting groove 15 and the connecting end 24, on the other the melting braze material 3 is automatically introduced into the auxiliary channels 152. If the melting braze material 3 is completely filled, the filling space 16 of the golf club head body 1 can serve to reservoir the redundant melting braze material 3 in the event. After brazing, the melting braze material 3 is cooled down and hardened to form a welded layer (not shown) so that the striking plate 2 securely connects to the golf club head body 1. Consequently, an assembled relationship of the golf club head body 1 and the striking plate 2 can be accomplished by means of press fitting, deformation engagement and brazing. Thereby, the intensified structure can intensify the connection structure and enhance connection reliability of the golf club head.

Figure 4:
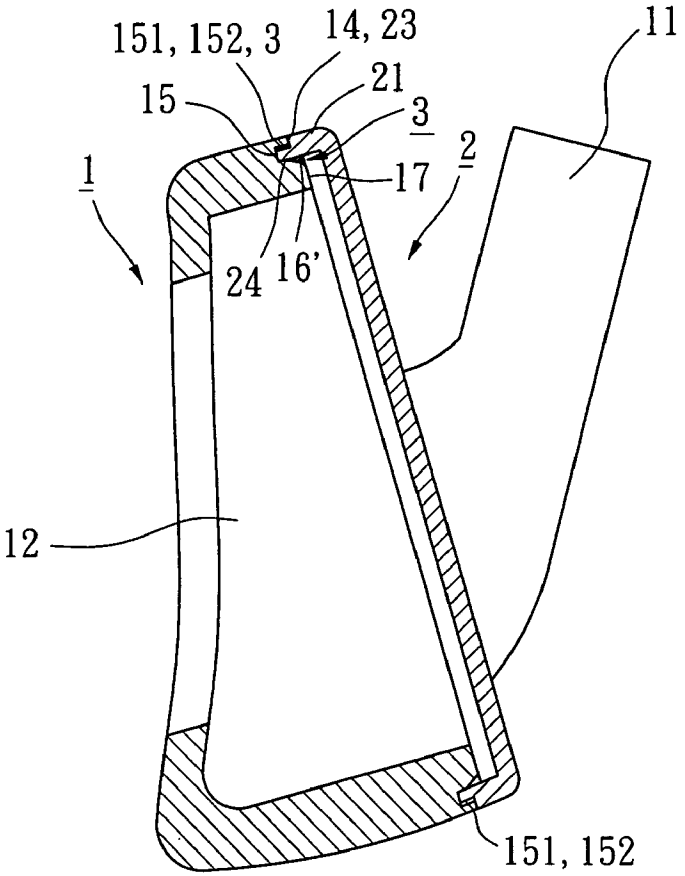
FIG. 4 is a cross-sectional view of the golf club head having the intensified structure connected the club head body with the striking plate in accordance with a second embodiment of the present invention.

Turning now to FIG. 4, reference numerals of the second embodiment of the present invention have applied the identical numerals of the first embodiment, as shown in FIG. 1. The construction of the golf club head structure in accordance with the second embodiment of the present invention has similar configuration and same function as that of the golf club head structure of the first embodiment and detailed descriptions may be omitted.

Referring again to FIG. 4, in comparison with the first embodiment, the filling space 16' of the golf club head body 1 of the second embodiment has an inclination of an inclined or curved surface to the connecting groove 15 so as to provide a large filling space. Also, the inclination of the filling space 16' is provided for easy guidance of the melting braze material 3 in brazing. After brazing, the melting braze material 3 is cooled down and hardened to form a welded layer in the filling space 16' so that the striking plate 2 securely connects to the golf club head body 1. Consequently, an assembled relationship of the golf club head body 1 and the striking plate 2 can be accomplished by means of press fitting, deformation engagement and brazing. Thereby, the intensified structure can intensify the connection structure and enhance connection reliability of the golf club head.

Turning now to FIGS. 5, 5*a*, 6 and 7, reference numerals of the third embodiment of the present invention have applied the identical numerals of the first embodiment, as shown in FIG. 1. The construction of the golf club head structure in accordance with the third embodiment of the present invention has similar configuration and same function as that of the golf club head structure of the first embodiment and detailed descriptions may be omitted.

Referring again to FIGS. 5, 5*a*, 6 and 7, in comparison with the first embodiment, the connecting groove 15 of the golf club head body 1 of the third embodiment is formed the engaging protrusions 153 and the auxiliary channels 154 therein for engaging with the connecting end 24 of the striking plate 2. The engaging protrusions 153 are disposed along the inner peripheral wall of the connecting groove 15 proximate to the filling space 16. Each of the engaging protrusions 153 has a cross-sectional shape, which is selected from a group consisting of a semi-circular section, a trapezoid section, a triangular section etc., in facilitating deformation in press fitting process. In brazing, due to gravity and capillary attraction, the melting braze material 3 is automatically introduced into the auxiliary channels 152 to form the welded layer (not shown).

Figure 8:
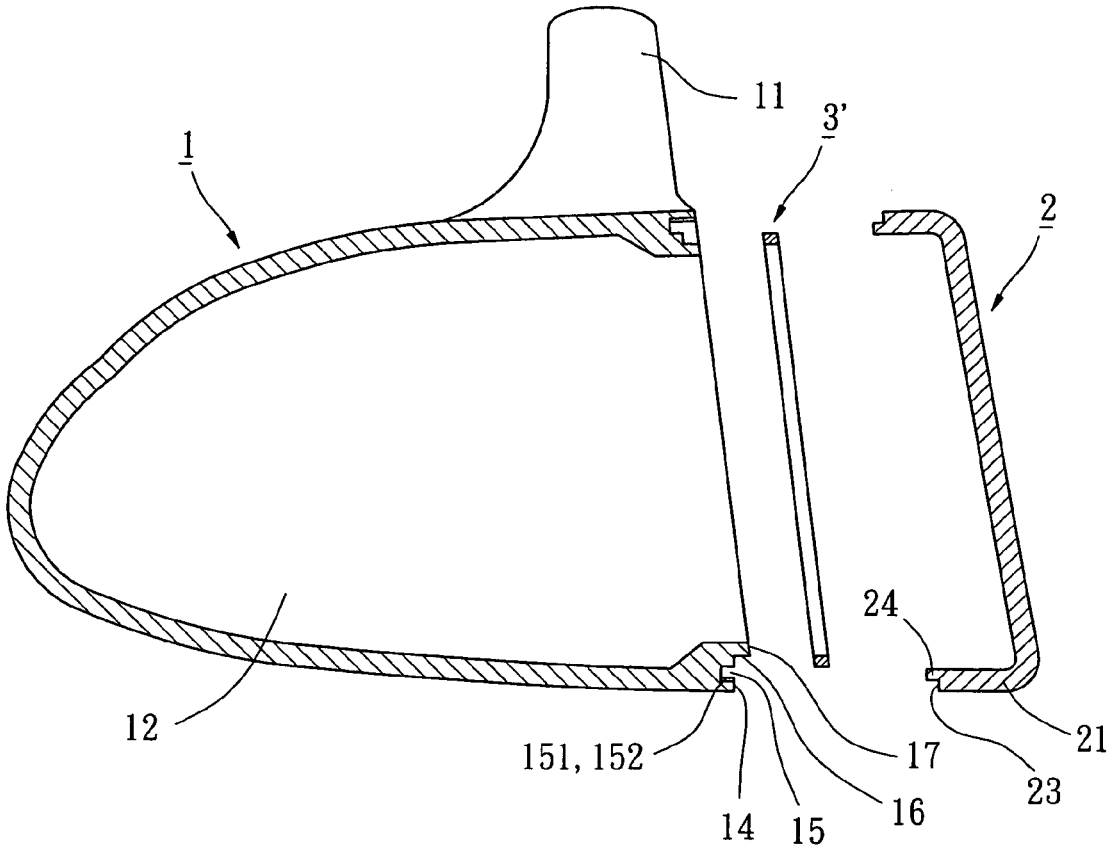
FIG. 8 is an exploded cross-sectional of the golf club head having the intensified structure for connecting the club head body with the striking plate in accordance with a fourth embodiment of the present invention.

Turning now to FIG. 8, reference numerals of the fourth embodiment of the present invention have applied the identical numerals of the first embodiment, as shown in FIG. 1. The construction of the golf club head structure in accordance with the fourth embodiment of the present invention has similar configuration and same function as that of the golf club head structure of the first embodiment and detailed descriptions may be omitted.

Referring again to FIG. 8, in comparison with the first embodiment, the intensified structure for the golf club head of the fourth embodiment is applied to wood-type club head. Prior to assembling the golf club head body 1 and the striking plate 2, a ring-shaped braze material 3' is inserted into the filling space 16 of the golf club head body 1 for the brazing process. In brazing, the ring-shaped braze material 3' contained in the filling space 16 of the golf club head body 1 is heated and thus melted. The melting braze material 3' is automatically filled within a clearance between the connecting groove 15 and the connecting end 24 due to gravity and capillary attraction. After brazing, the melting braze material 3' is cooled down and hardened to form a welded layer (not shown) so that the striking plate 2 securely connects to the golf club head body 1.

As has been discussed above, outflow of the braze material from the conventional golf club head structure causes caves and voids between the golf club head body and the striking plate that may weaken the entire structure of the golf club head. However, the intensified structure of the connecting groove 15, the filling space 16 and the engaging protrusions 151 of the golf club head body 1 securely connects the connecting end 24 of the striking plate 2, thereby intensifying the connection structure and enhances connection reliability of the golf club head.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. An intensified structure for a golf club head comprising:

a golf club head body including an opening at a front side;

a braze-material filling space provided on a periphery of the opening;

a connecting groove provided on the periphery of the opening and located closely adjacent to the braze-material filling space;

a striking plate adapted to connect to the opening of the golf club head body, the striking plate further including an annular upright bent wall formed at a periphery, said annular unright bent wall being bent to align with said connecting groove which is located closely adjacent to said braze-material filling space; and a connecting wall connected to the annular upright bent wall;

wherein said connecting wall is press-fitted into said connecting groove so that the striking plate securely connects to the golf club head body;

wherein said braze-material filling space is filled with a braze material which is melted and filled within a clearance between the connecting groove of the golf club head body and the connecting end of the striking plate to form a welded layer.

2. The intensified structure for the golf club head as defined in claim 1, wherein the golf club head body further includes an engaging shoulder engaged with an engaging shoulder of the striking plate.

3. The intensified structure for the golf club head as defined in claim 2, wherein the connecting groove includes an inner peripheral wall formed with a plurality of engaging protrusions proximate to the engaging shoulder of the golf club head body, said engaging protrusions are engaged with the connecting end of the striking plate and any two said adjacent engaging protrusions providing an auxiliary channel for receiving the melting braze material.

4. The intensified structure for the golf club head as defined in claim 1, wherein the connecting groove includes an inner peripheral wall formed with a plurality of engaging protrusions are proximate to the braze-material filling space of the golf club head body, said engaging protrusions are engaged with the connecting end of the striking plate and any two said adjacent engaging protrusions providing an auxiliary channel for receiving the melting braze material.

5. The intensified structure for the golf club head as defined in claim 1, wherein the golf club head body further includes an annular lip to form a side wall of the braze-material filling space so as to obstruct the melting braze material so that outflow of the melting braze material from the braze-material filling space can be prevented.

6. The intensified structure for the golf club head as defined in claim 1, wherein the braze-material filling space has a side wall and a bottom wall commonly defining a cornered portion.

7. The intensified structure for the golf club head as defined in claim 1, wherein the braze-material filling space has an inclination of an inclined or curved surface to the connecting groove.

8. The intensified structure for the golf club head as defined in claim 3, wherein each of the engaging protrusions has a cross-sectional shape, which is selected from a group consisting of a semi-circular section, a trapezoid section, and a triangular section, in facilitating deformation in a press fitting process.

9. The intensified structure for the golf club head as defined in claim 4, wherein each of the engaging protrusions has a cross-sectional shape, which is selected from a group consisting of a semi-circular section, a trapezoid section, and a triangular section, in facilitating deformation in a press fitting process.

10. The intensified structure for the golf club head as defined in claim 1, the braze-material flowing space has a depth at a cornered portion not greater than that of the connecting groove that permits the melting braze material flowing into the connecting groove.

11. The intensified structure for the golf club head as defined in claim 1, wherein the braze-material filling space connects with an inner peripheral wall of the connecting groove.

12. The intensified structure for the golf club head as defined in claim 1, wherein the braze-material filling space is adjacent to engaging protrusions provided on an inner peripheral wall of the connecting groove.

13. The intensified structure for the golf club head as defined in claim 1, wherein the braze-material filling space is located at an inner side of the periphery of the opening of the golf club head body.

14. The intensified structure for the golf club head as defined in claim 1, wherein the braze-material filling space is filled with the braze material prior to a braze welding process.

15. The intensified structure for the golf club head as defined in claim 1, wherein the braze-material filling space has an inclination of an inclined or curved surface to the connecting groove.

16. An intensified structure far a golf club head comprising:

a golf club head body including an opening at a front side;

a braze-material filling space provided on a periphery of the opening;

a connecting groove provided on the periphery of the opening and located closely adjacent to the braze-material filling space;

a striking plate adapted to connect to the opening of the golf club head body, the striking plate further including an annular upright bent wall formed at a periphery, said annular upright bent wall being bent to align with said connecting groove which is located closely adjacent to said braze-material filling space; and a connecting wall connected to the annular upright bent wall;

wherein said connecting wall is inserted into said connecting groove so that the striking plate securely connects to the golf club head body;

wherein said braze-material filling space defines a height of an annular lip higher than that of an engaging shoulder of the golf club head body adjacent to the connecting groove.

17. The intensified structure for the golf club head as defined in claim 16, wherein the engaging shoulder of the golf club head body is engaged with an engaging shoulder of the striking plate.

18. The intensified structure for the golf club head as defined in claim 17, wherein the connecting groove includes an inner peripheral wall formed with a plurality of engaging protrusions proximate to the engaging shoulder of the golf club head body, said engaging protrusions are engaged with the connecting end of the striking plate and any two said adjacent engaging protrusions providing an auxiliary channel for receiving the melting braze material.

19. The intensified structure for the golf club head as defined in claim 18, wherein each of the engaging protrusions has a cross-sectional shade, which is selected from a group consisting of a semi-circular section, a trapezoid section, and a triangular section, in facilitating deformation in a press fitting process.

20. The intensified structure for the golf club head as defined in claim 16, wherein the connecting groove includes an inner peripheral wall formed with a plurality of engaging protrusions proximate to the braze-material filling space of the golf club head body, said engaging protrusions are engaged with the connecting end of the striking plate and any two said adjacent engaging protrusions providing an auxiliary channel for receiving the melting braze material.

21. The intensified structure for the golf club head as defined in claim 20, wherein each of the engaging protrusions has a cross-sectional shape, which is selected from a group consisting of a semi-circular section, a trapezoid section, and a triangular section, in facilitating deformation in a press fitting process.

22. The intensified structure for the golf club head as defined in claim 16, wherein the annular lip of the golf club head body further defines a side wall of the braze-material filling space so as to obstruct the melting braze material so that outflow of the melting braze material from the braze-material filling space can be prevented.

23. The intensified structure for the golf club head as defined in claim 16, wherein the braze-material filling space has a side wall and a bottom wall commonly defining a cornered portion.

24. The intensified structure for the golf club as defined in claim 16, the braze-material filling space has a depth at a cornered portion not greater than that of the connecting groove that permits the melting braze material flowing into the connecting groove.

25. The intensified structure for the golf club head as defined in claim 16, wherein the braze-material filling space connects with an inner peripheral wall of the connecting groove.

26. The intensified structure for the golf club head as defined in claim 16, wherein the braze-material filling space is adjacent to engaging protrusion provided on an inner peripheral wall of the connecting groove.

27. The intensified structure for the golf club head as defined in claim 16, wherein the braze-material filling space is located at an inner side of the periphery of the opening of the golf club head body.

28. The intensified structure for the golf club head as defined in claim 16, wherein the braze-material filling space is filled with the braze material prior to a braze welding process.

* * * * *